US005841054A

United States Patent [19]

Komano et al.

[11] Patent Number: 5,841,054

[45] Date of Patent: Nov. 24, 1998

[54] MUSICAL TONE SYNTHESIZING APPARATUS HAVING COMPETIBILITY OF TONE COLOR PARAMETERS FOR DIFFERENT SYSTEMS

[75] Inventors: Takeshi Komano; Toshifumi Kunimoto; Masahiro Kakishita, all of Hamamatsu, Japan

[73] Assignee: Yamaha Corporation, Hamamatsu, Japan

[21] Appl. No.: 832,241

[22] Filed: Apr. 3, 1997

[30] Foreign Application Priority Data

Apr. 6, 1996 [JP] Japan ..... 8-110218

[51] Int. Cl.[6] ..... G10H 1/06

[52] U.S. Cl. ..... 84/622

[58] Field of Search ..... 84/622–625

[56] References Cited

U.S. PATENT DOCUMENTS

| | | | |
|---|---|---|---|
| 4,297,933 | 11/1981 | Nishimoto . | |
| 4,843,938 | 7/1989 | Hideo . | |
| 5,270,477 | 12/1993 | Kawashima | 84/622 |
| 5,272,275 | 12/1993 | Kunimoto . | |
| 5,286,916 | 2/1994 | Yamauchi . | |
| 5,319,151 | 6/1994 | Shiba et al. | 84/622 X |
| 5,340,940 | 8/1994 | Iizuka et al. | 84/622 |
| 5,352,849 | 10/1994 | Kobayashi . | |
| 5,376,752 | 12/1994 | Limberis et al. | 84/622 |
| 5,412,154 | 5/1995 | Takeda et al. | 84/622 |
| 5,481,065 | 1/1996 | Yamada | 84/622 X |
| 5,596,159 | 1/1997 | O'Connell | 84/622 |
| 5,604,324 | 2/1997 | Kubota et al. | 84/622 |

FOREIGN PATENT DOCUMENTS

| | | |
|---|---|---|
| 4-181296 | 6/1992 | Japan . |
| 5-46179 | 2/1993 | Japan . |
| 5-143079 | 6/1993 | Japan . |
| 6-259087 | 9/1994 | Japan . |
| 9-6364 | 1/1997 | Japan . |

*Primary Examiner*—Stanley J. Witkowski
*Attorney, Agent, or Firm*—Graham & James LLP

[57] ABSTRACT

A musical tone synthesizing apparatus utilizes digital signal processors (DSPs) to realize synthesis of musical-tone waveforms with regard to a variety of tone colors. The apparatus stores microprograms and tone-color parameters in advance. Herein, the microprograms represent musical-tone-synthesis algorithms each synthesizing musical tones of a specific tone color. The tone-color parameters contain common parameters and selective parameters to provide a compatibility between different systems having different scales in hardware and software. The common parameters are commonly shared by the different systems, while the selective parameters are provided for a selective use of the musical-tone-synthesis algorithms. So, the apparatus responds to a selection of the musical-tone-synthesis algorithms, wherein the apparatus executes the selected musical-tone-synthesis algorithm, using the common parameters and at least one of the selective parameters, to synthesize musical-tone waveforms with regard to a desired tone color. Incidentally, it is possible to provide different algorithms with regard to derivative tone colors which derive from a base tone color.

29 Claims, 6 Drawing Sheets

MUSICAL TONE SYNTHESIZING APPARATUS HAVING COMPETIBILITY OF TONE COLOR PARAMETERS FOR DIFFERENT SYSTEMS

BACKGROUND OF THE INVENTION

1. Field of the Invention

The invention relates to musical tone synthesizing apparatuses which synthesize musical tone waveforms with regard to musical tones of a desired tone color in accordance with one of musical-tone-synthesis algorithms.

2. Prior Art

Recently, the system of the musical tone synthesizing apparatuses is constructed using digital signal processors (DSPs), micro-processor units (MPUs) and software (i.e., microprograms of DSPs; or programs of MPUs). Such a system construction allows the musical tone synthesizing apparatus to easily change algorhtims provided for the synthesis of musical tones. In addition, it is possible to realize the musical tone synthesizing apparatus having a high degree of freedom and a high degree of flexibility. The above system construction is applicable to plural kinds of sound sources such as the so-called 'physical-model' sound sources, waveform-memory-read-out-type sound sources and frequency-modulation-type (FM-type) sound sources to provide some advantages. For example, the published papers like Japanese Patent Laid-Open No.5-143079 disclose the physical-model sound sources which synthesize musical-tone waveforms by simulating tone-generation mechanisms suited to a variety of acoustic instruments.

Meanwhile, scales of musical-tone-synthesis algorithms, which can be built in the musical tone synthesizing apparatuse using processors, depend on a variety of conditions. Namely, the conditions correspond to processing speeds of the processors, a number of processors and scales of programs, which can be executed on the processors, as well as the capacity of the processors in execution of programs. In addition, the scales of the algorithms are affected by the sampling frequencies used for the musical-tone synthesis as well as a number of musical tones to be generated simultaneously. For example, a large-scale musical tone synthesizing apparatus is constructed using 2 DSPs having a high processing speed. In case of the large-scale musical tone synthesizing apparatus, it is possible to provide a great number of steps of microprograms, so it is possible to synthesize musical-tone waveforms in accordance with musical-tone-synthesis algorithms of a large scale and a high performance. In contrast, a small-scale musical tone synthesizing apparatus is constructed using a single DSP having a low processing speed, for example. In case of the small-scale musical tone synthesizing apparatus, it is not possible to provide a great number of steps of microprograms, so musical-tone waveforms are synthesized in accordance with small-scale musical-tone-synthesis algorithms.

The scale of the system which is built in the apparatus is a most important factor for determining the cost required to manufacture the apparatus. Normally, the musical tone synthesizing apparatuses are designed based on the reference system configuration corresponding to a full-scale musical tone synthesizing apparatus which operates in accordance with full-scale algorithms and which is constructed using a number of processors requiring a high cost. Herein, the central portion of the reference system configuration is not changed, whilst peripheral portions are changed to realize down-sizing of the apparatus. For example, some peripheral blocks are deleted or changed to reduce the scales of the algorithms, thus providing a musical tone synthesizing apparatus which is constructed using a small number of processors requiring a low cost.

As described above, it is possible to design different scales of the musical tone synthesizing apparatuses, which may require different tone-color parameters. However, if the tone-color parameters are created for the individual apparatus, the cost required for the creation of the tone colors should be increased. In short, the conventional musical tone synthesizing apparatuses do not have the compatibility to exchange tone-color parameters therebetween.

SUMMARY OF THE INVENTION

It is an object of the invention to provide a musical tone synthesizing apparatus which is capable of synthesizing musical-tone waveforms based on common tone-color parameters which are commonly shared by different scales of systems.

A musical tone synthesizing apparatus utilizes digital signal processors (DSPs) to realize synthesis of musical-tone waveforms with regard to a variety of tone colors. The apparatus stores microprograms and tone-color parameters in advance. Herein, the microprograms represent musical-tone-synthesis algorithms, each synthesizing musical tones of a specific tone color. The tone-color parameters contain common parameters and selective parameters to provide a compatibility between different systems having different scales in hardware and software. Herein, the common parameters are commonly shared by the different systems, whilst the selective parameters are provided for a selective use of the musical-tone-synthesis algorithms. So, the apparatus responds to a selection of the musical-tone-synthesis algorithms, wherein the apparatus executes the selected musical-tone-synthesis algorithm, using the common parameters and at least one of the selective parameters, to simulate musical-tone waveforms with regard to a desired tone color.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Now, a preferred embodiment of the invention will be described with reference to the drawings.

Figure 1:
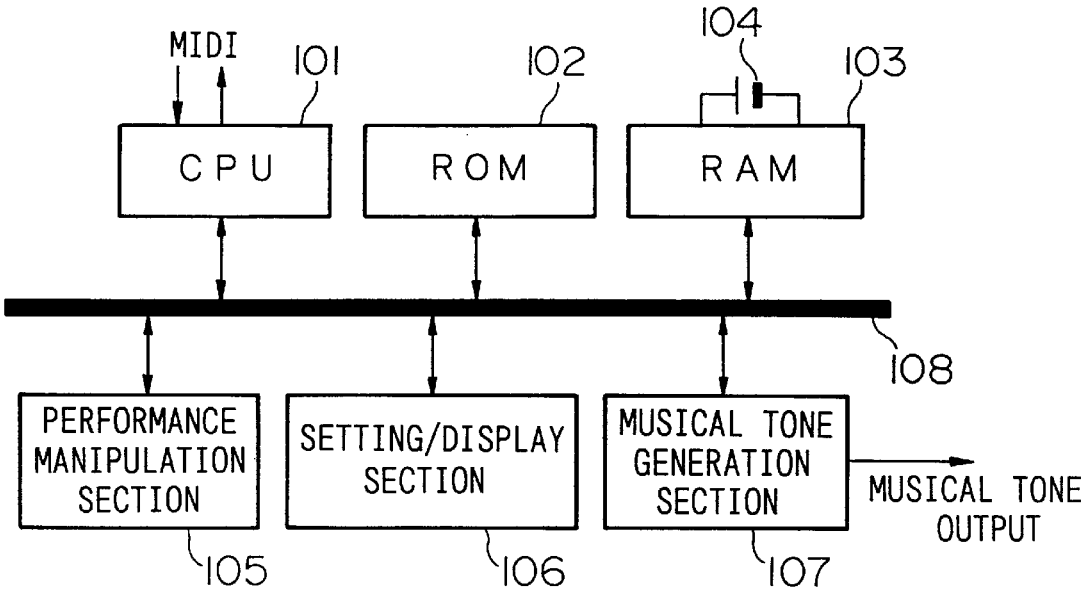
FIG. 1 is a block diagram showing a musical tone synthesizing apparatus which is designed in accordance with an embodiment of the invention.

FIG. 1 shows an overall system of a musical tone synthesizing apparatus which is designed in accordance with an embodiment of the invention. The musical tone synthesizing apparatus of FIG. 1 is configured by a central processing unit (CPU) 101, a read-only memory (ROM) 102, a random-access memory (RAM) 103, a performance manipulation section 105, a setting/display section 106, a musical tone generation section 107 and a system bus line 108.

The CPU 101 performs an overall control on the musical tone synthesizing apparatus. The contents of processing of the CPU 101 will be described later with reference to flowcharts of FIGS. 6, 7A, 7B, 8A and 8B. The ROM 102 stores control programs, executed by the CPU 101, as well as 'preset' tone-color parameters. The RAM 103 is used as a work area and a variety of buffers for the CPU 101. In addition, the system of the present embodiment secures areas to store 'user-defined' tone-color parameters in the RAM 103. Incidentally, the RAM 103 is equipped with a back-up battery 104, so it is possible to retain the stored contents of the RAM 103 even when a power supply to the musical tone synthesizing apparatus is turned OFF.

The performance manipulation section 105 corresponds to a keyboard providing a number of keys which are manipulated by a human operator (or a user) to play musical performance. The setting/display section 106 is constructed by a liquid crystal display (LCD) and panel switches which are arranged on a panel face of the apparatus. So, a variety of information and data are visually displayed on a screen of the liquid crystal display. Particularly, the panel switches contain tone-color-select switches to select tone colors. Incidentally, if the apparatus of FIG. 1 is constructed in a small-scale form which will be described later, the panel switches contain a mode select switch which selects either a first mode or a second mode. The musical tone generation section 107 synthesizes data representing musical tones based on instructions given from the CPU 101. The CPU 101 detects manipulating operations applied to performance manipulation members of the performance manipulation section 105 (i.e., keys of the keyboard); or the CPU 101 receives MIDI signals given from a MIDI device externally provided (where 'MIDI' is an abbreviation for the standard of 'Musical Instrument Digital Interface'). So, the CPU 101 creates instructions based on them to instruct the musical tone generation section 107 to generate musical tones.

Figure 2A:
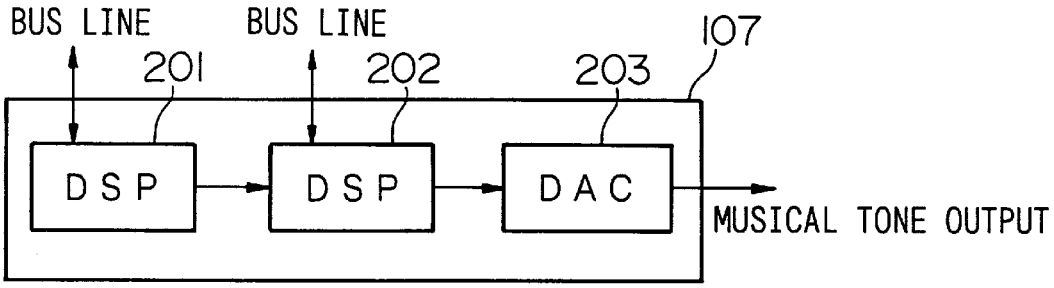
FIG. 2A is a block diagram showing an example of an internal configuration of a large-scale musical tone generation section.
Figure 2B:
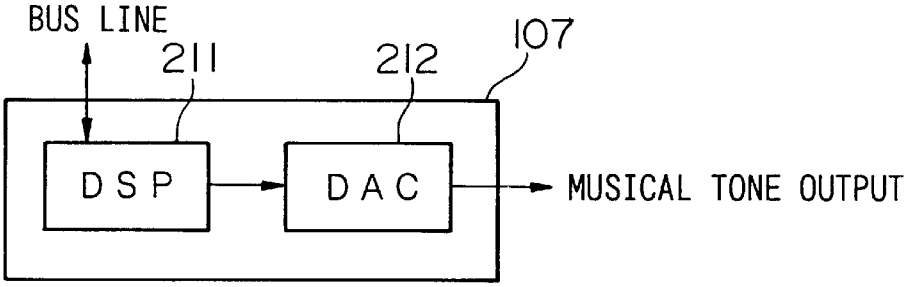
FIG. 2B is a block diagram showing an example of an internal configuration of a small-scale musical tone generation section.

FIGS. 2A and 2B show examples of an internal configuration of the musical tone generation section 107. Specifically, FIG. 2A is a block diagram showing a large-scale configuration of the musical tone generation section 107, whilst FIG. 2B is a block diagram showing a small-scale configuration of the musical tone generation section 107. The musical tone generation section 107 of the large-scale configuration of FIG. 2A contains 2 DSPs 201 and 202. So, musical-tone waveforms synthesized by the DSPs 201 and 202 are subjected to digital-to-analog conversion by a digital-to-analog converter (DAC) 203, thus outputting analog signals representing musical tones. On the other hand, the musical tone generation section 107 of the small-scale configuration of FIG. 2B contains only one DSP 211. So, musical-tone waveforms synthesized by the DSP 211 are subjected to digital-to-analog conversion by a digital-to-analog converter (DAC) 212, thus outputting analog signals representing musical tones.

Figure 3:
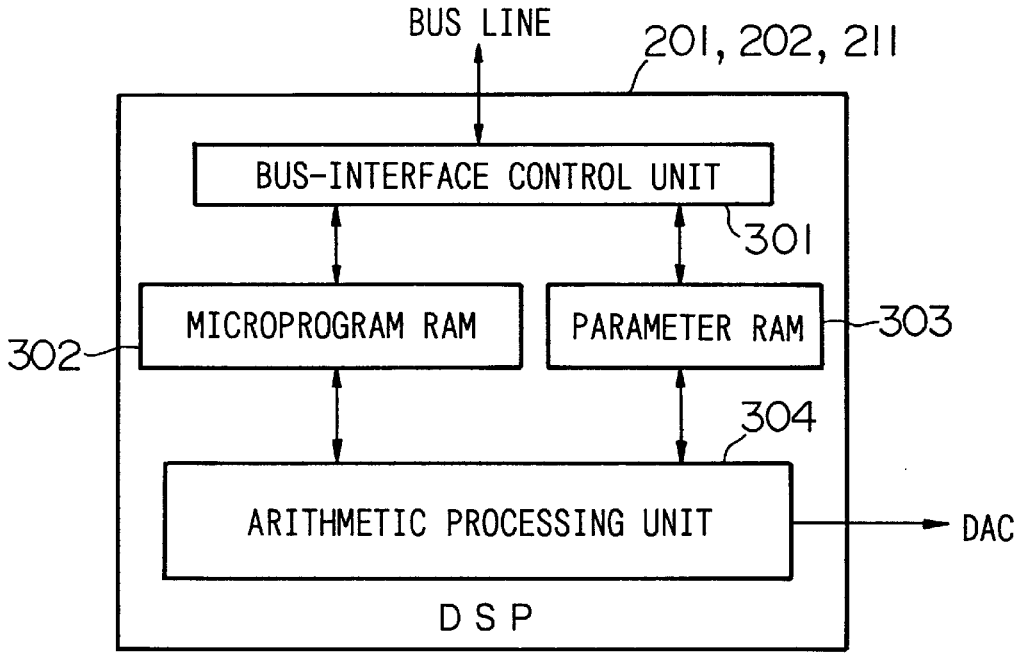
FIG. 3 is a block diagram showing an example of an internal configuration of a DSP.

FIG. 3 shows an example of an internal configuration of a DSP which represents the aforementioned DSPs 201, 202 and 211 respectively. The DSP of FIG. 3 is configured by a bus-interface control unit 301, a microprogram RAM 302, a parameter RAM 303 and an arithmetic processing unit 304. The bus-interface control unit 301 provides the interface for communications of a variety of information and data in connection with the CPU 101 and other sections connected with the bus line 108. The microprogram RAM 302 stores microprograms which are sent thereto in accordance with instructions of the CPU 101. The parameter RAM 303 stores parameters (e.g., tone-color parameters) which are sent thereto in accordance with instructions of the CPU 101. The arithmetic processing unit 304 executes the microprograms, stored in the microprogram RAM 302, to perform arithmetic operations (or calculations) using the parameters stored in the parameter RAM 303. Thanks to the calculations, musical tone waveforms are synthesized in accordance with musical-tone-synthesis algorithms which are defined by the microprograms to be executed. So, the arithmetic processing unit 304 synthesizes 'digital' musical-tone waveforms, which are then forwarded to the DAC.

Figure 4A:
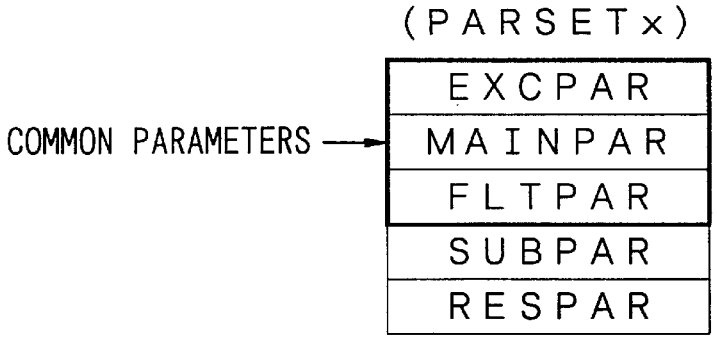
FIG. 4A shows an example of a memory map for storing a tone-color-parameter set.
Figure 4B:
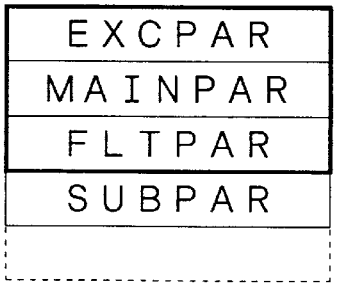
FIG. 4B shows a memory map for storing tone-color parameters with respect to a first mode.
Figure 4C:
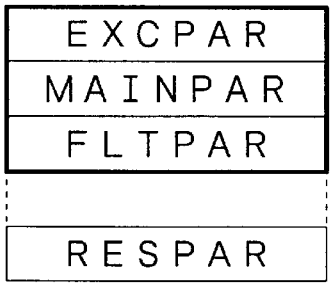
FIG. 4C shows a memory map for storing tone-color parameters with respect to a second mode.

FIGS. 4A to 4C show examples of configurations of tone-color parameters. Herein, FIG. 4A shows a set of tone-color parameters which are supplied to the musical tone generation section 107, having the large-scale configuration of FIG. 4A, in the musical tone synthesizing apparatus of FIG. 1. Such a 1 set of parameters shown in FIG. 4A is represented by a tone-color-parameter set 'PARSETx' and is used to define one tone color. The ROM 102 provides tone-color-parameter sets with respect to tone colors respectively, wherein the ROM 102 has a memory map, as shown in FIG. 4A, to store one tone-color-parameter set for one tone color. In addition, the ROM 102 provides microprograms with respect to tone colors respectively. So, the CPU 101 sends microprograms, corresponding to a tone color which is selected by a user, to the microprogram RAM 302 of the DSP provided inside of the musical tone generation section 107. Further, the CPU 101 sends a tone-color-parameter set (see FIG. 4A), corresponding to the tone color selected by the user, to the parameter RAM 303 of the DSP provided inside of the musical tone generation section 107. When the CPU 101 issues instructions to generate musical tones, the musical tone generation section 107 executes the microprograms of the microprogram RAM 302 using the parameters of the parameter RAM 303, thus performing a musical tone synthesis.

FIGS. 4B and 4C show tone-color parameters which are supplied to the musical tone generation section 107, having the small-scale configuration of FIG. 2B, in the musical tone synthesizing apparatus of FIG. 1. In case of the small-scale configuration, it is possible to select either the first mode or second mode in response to a manipulation of the mode select switch provided in the setting/display section 106 in the musical tone synthesizing apparatus of FIG. 1. Responding to a selection of the mode, the apparatus changes over musical-tone-synthesis algorithms to be executed. Details will be described later in conjunction with FIG. 5. By the way, the apparatus utilizing the small-scale configuration employs a same memory map of FIG. 4A for the ROM 102 although we have described that the memory map of FIG. 4A is used to store the tone-color-parameter set with regard to the large-scale configuration. So, in case of the small-scale configuration, the tone-color parameters, which are provided for tone colors respectively, are stored in the ROM 102 by the memory map of FIG. 4A as well.

When a user selects a tone color, the CPU 101 accesses to the ROM 102 which stores tone color parameters by the memory map shown in FIG. 4A. So, the CPU 101 extracts certain parameters corresponding to the tone color selected by the user, from the tone-color parameters in accordance with a mode currently selected. Then, the extracted parameters are sent to the parameter RAM 303 of the DSP provided inside of the musical tone generation section 107. In case of the first mode, the CPU 101 extracts parameters shown in FIG. 4B from the tone-color-parameter set shown in FIG. 4A. Thus, the extracted parameters of FIG. 4B are sent to the parameter RAM 303 of the DSP provided inside of the musical tone generation section 107. In case of the second mode, the CPU 101 extracts parameters shown in FIG. 4C from the tone-color-parameter set of FIG. 4A. Thus, the extracted parameters of FIG. 4C are sent to the parameter RAM 303 of the DSP provided inside of the musical tone generation section 107. Incidentally, when the user selects the tone color, the CPU 101 accesses to the ROM 102 which stores microprograms with respect to tone colors and modes respectively. That is, the CPU 101 reads out microprograms in accordance with the selected tone color. Thus, the microprograms are sent to the microprogram RAM 302 of the DSP provided inside of the musical tone generation section 107. When the CPU 101 issues instructions to generate musical tones, the musical tone generation section 107 executes the microprograms of the microprogram RAM 302 using the parameters of the parameter RAM 303 so as to perform a musical tone synthesis.

As described heretofore, the same tone color parameters stored in the ROM 102 can be utilized in both of the large-scale configuration and small-scale configuration of the musical tone generation section 107. Therefore, even if the apparatus is designed in a variety of scales, it is not necessary to re-create tone-color parameters with respect to each scale of the apparatus. Particularly, 3 parameters surrounded by a bold line in FIG. 4A are utilized by basic blocks of a musical-tone-synthesis algorithm whose content will be described later in conjunction with FIG. 5. So, the above 3 parameters are certainly sent to the musical tone generation section 107 even in the case of the small-scale configuration, regardless of the mode. Those 3 parameters are common parameters which basically define the tone color. So, the common parameters are shared by many apparatuses, regardless of the scales and modes. Thus, it is possible to establish a compatibility in tone colors between manufactured products having different scales. Incidentally, parameters other than the common parameters are selective parameters which are selectively used in accordance with the modes. So, the selective parameters are adequately sent to the musical tone generation section 107.

Actually, there are provided a more number of parameters other than the parameters described above. For convenience's sake, FIGS. 4A to 4C simply show the 'representative' parameters only. By the way, the present embodiment is described in such a way that the tone-color parameters each have fixed values stored in the ROM 102. However, it is possible to use 'variable-like' parameters whose values dynamically vary. For example, tone-color parameters can be created by effecting certain calculations, using certain numbers stored in the ROM 102, on manipulation information which is produced in response to an operator's manipulation of the performance manipulation section 105. So, the above tone-color parameters are sent to the parameter RAM 303 of the DSP provided inside of the musical tone generation section 107 every time the CPU issues instructions to generate musical tones.

Figure 5:
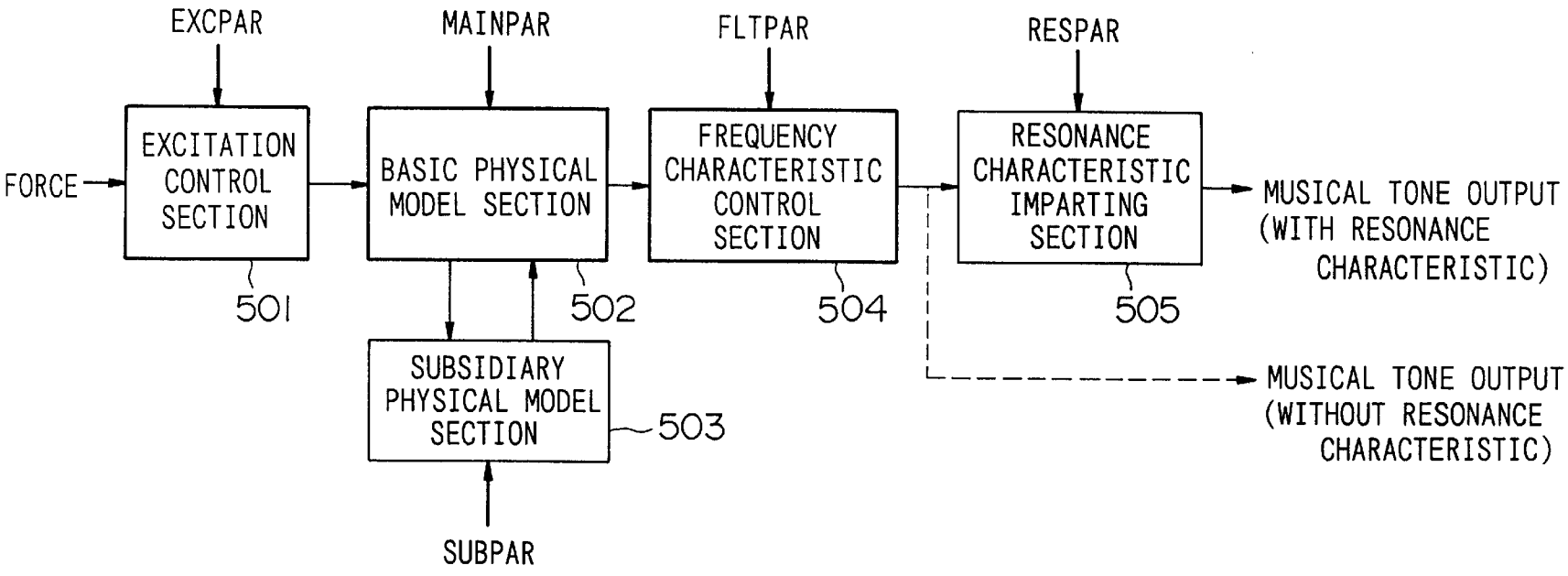
FIG. 5 is a block diagram showing an example of a musical-tone-synthesis algorithm.

FIG. 5 is a block diagram showing an example of a musical-tone-synthesis algorithm which is realized by the musical tone generation section 107 described heretofore. Actually, the DSP of the musical tone generation section 107 executes the microprograms to perform a musical tone synthesis based on the musical-tone-synthesis algorithm. Particularly, FIG. 5 shows an algorithm of a physical-model sound source which is realized by the musical tone generation section 107 having the large-scale configuration shown in FIG. 2A. The algorithm of FIG. 5 is capable of simulating tone-generation mechanisms of a variety of acoustic instruments.

In FIG. 5, an excitation control section 501 produces an excitation signal based on a drive signal 'FORCE' and an input parameter 'EXCPAR'. Herein, the drive signal FORCE is a physical-model drive signal which responds to a performance manipulation made by a performer (or a human operator). So, the drive signal represents information which responds to some external force imparted to blowing pressure of a wind instrument or a string of a stringed instrument, for example. The excitation signal outputted from the excitation control section 501 is forwarded to a basic physical model section 502.

The basic physical model section 502 performs calculations, based on the excitation signal and a parameter MAINPAR, so as to simulate a basic tone-generation mechanism of an acoustic instrument. If the basic physical model section 502 is constructed to simulate a tone-generation mechanism of a wind instrument, for example, the basic physical model section 502 is designed to simulate a resonating operation of a tube in which an air flow is blown. If the basic physical model section 502 is constructed to simulate a tone-generation mechanism of a stringed instrument, the basic physical model section 502 is designed to simulate vibrating operations of a string which is struck, plucked or bowed. Examples of configurations of the excitation control section 501 and the basic physical model section 502 are disclosed by the papers like Japanese Patent Laid-Open No. 5-143079, U.S. Pat. Nos. 5,286,916 and 5,272,275, for example.

A subsidiary physical model section 503 performs calculations , based on a parameter SUBPAR, so as to simulate a subsidiary operation of the tone-generation mechanism of the acoustic instrument. In case of the wind instrument, for example, the section 503 corresponds to simulation of a throat section of a performer, which is disclosed by the papers like Japanese Patent Laid-Open No. 4-181296. In case of the stringed instrument, the section 503 corresponds to simulation of a resonating string, which is disclosed by the papers like U.S. Pat. No. 5,352,849.

The musical-tone waveform signal outputted from the basic physical model section 502 is forwarded to a frequency characteristic control section 504. The frequency characteristic control section 504 performs a frequency characteristic control on the musical-tone waveform signal based on a parameter FLTPAR. Then, the musical-tone waveform signal, controlled by the frequency characteristic control section 504, is forwarded to a resonance characteristic imparting section 505. The resonance characteristic imparting section 505 imparts a resonance characteristic, based on a parameter RESPAR, to the musical-tone waveform signal outputted from the frequency characteristic control section 504. This section 505 corresponds to simulation of a body of an instrument such as a violin or an acoustic plate of a piano, for example, which is disclosed by the papers like Japanese Patent Laid-Open Nos. 6-259087 and 5-46179.

In case of the large-scale configuration, all the blocks shown in FIG. 5 are made effective to construct an algorithm for synthesizing a musical-tone waveform. In this case, as described before, a tone-color-parameter set (see FIG. 4A), corresponding to the selected tone color, is set to the parameter RAM 303 of the DSP provided inside of the musical tone generation section 107. So, parameters corresponding to the selected tone color are supplied to the blocks of FIG. 5 respectively.

In case of the small-scale configuration, some of the blocks of FIG. 5, which are suited to the mode currently selected, are made effective to construct an algorithm for synthesizing a musical-tone waveform. In the first mode, the present embodiment excludes the resonance characteristic imparting section 505 but uses the blocks 501 to 504 so as to construct an algorithm. Herein, the frequency characteristic control section 504 provides a musical tone output. In the second mode, the present embodiment excludes the subsidiary physical model section 503 but uses the blocks 501, 502, 504 and 505 so as to construct an algorithm for a musical tone synthesis. In FIG. 5, the blocks 501, 502 and 504, drawn by bold lines, are used to basically define the tone color; in other words, those blocks are basic blocks for the musical-tone-synthesis algorithm. Therefore, the basic blocks are commonly used in both of the modes. So, the parameters EXCPAR, MAINPAR, FLTPAR respectively used by the basic blocks 501, 502, 504 are the common parameters of the tone-color parameters (see parameters surrounded by bold lines in FIGS. 4A, 4B, 4C). Those common parameters are commonly shared by the modes. The first mode excludes the block 505 but includes the block 503, so the parameter SUBPAR is additionally used with the common parameters. The second mode excludes the block 503 but includes the block 505, so the parameter RESPAR is additionally used with the common parameters.

As described above, in the case of the small-scale configuration, it is possible to realize a variety of algorithms by partially changing the musical-tone-synthesis algorithm of FIG. 5. Herein, the common parameters, corresponding to the basic blocks which basically define the tone color, are accompanied with the additional parameters, corresponding to the blocks which are selectively used or changed, to form 1 set of tone-color parameters which are stored in advance. Then, the present embodiment selects the parameters required to construct the algorithm in response to selection of the algorithm (or selection of the mode), so that the selected parameters are adequately supplied to the processor. Such a system configuration allows the apparatus to easily grasp the property of the tone colors although the tone colors are changed due to a partial change of the algorithm to provide 'derivative' tone colors. So, as compared to the primitive system which stores all the tone-color parameters with respect to the derivative tone colors respectively, the present system is capable of saving a memory capacity required to store the tone-color parameters.

Next, a detailed description will be given with respect to operations of the CPU 101, shown in FIG. 1, with reference to flowcharts.

Figure 6:
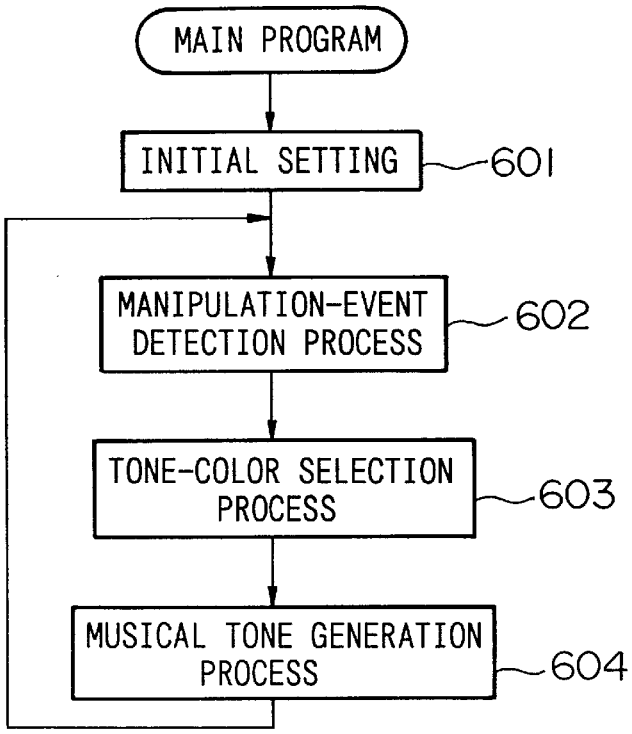
FIG. 6 is a flowchart showing a main program.

A flowchart of FIG. 6 shows a main program which is made active after a human operator turns ON a power-supply switch of the musical tone synthesizing apparatus. In step 601, initialization (or initial setting) is performed on a variety of regions and sections of the apparatus. Then, the CPU 101 performs a manipulation-event detection process of step 602, a tone-color selection process of step 603 (see FIGS. 8A and 8B) and a musical-tone generation process of step 604. In the manipulation-event detection process of step 602, the CPU 101 detects depression events and/or release events with respect to the performance manipulation members of the performance manipulation section 105; the CPU 101 detects note-on events and/or note-off events which are inputted thereto from a MIDI device; and the CPU 101 detects manipulation events of members (particularly the panel switches) of the setting/display section 106. In the musical-tone generation process of step 604, the CPU 101 issues tone-generation start instructions or mute instructions to the musical tone generation section 107 in response to the detected manipulation events of the performance manipulation members.

Figures 8A, 8B:
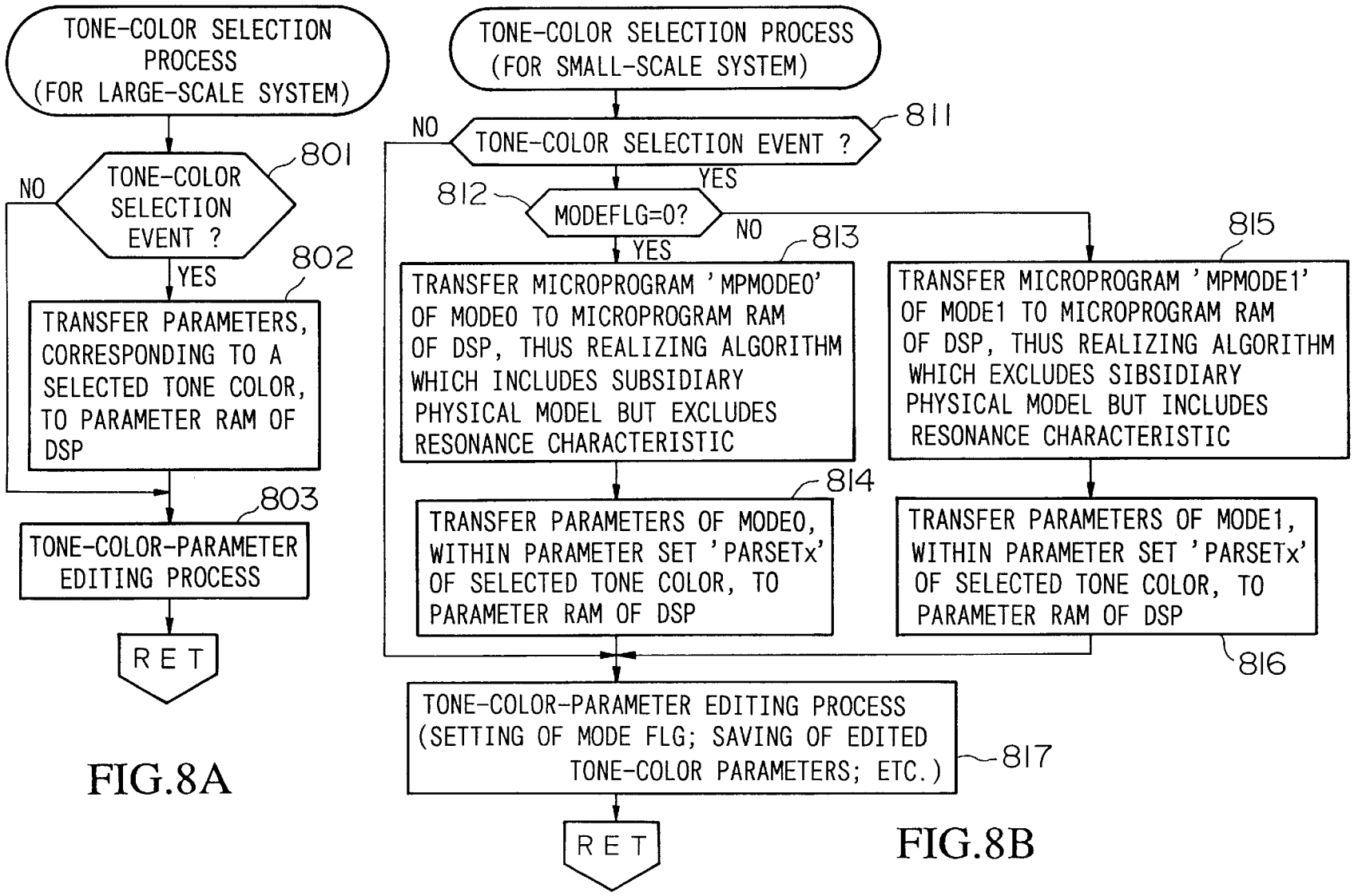
FIG. 8A is a flowchart showing a tone-color selection process for the large-scale configuration.
FIG. 8B is a flowchart showing a tone-color selection process for the small-scale configuration.

FIGS. 8A and 8B are flowcharts showing procedures of the tone-color selection process of step 603 shown in FIG. 6. The present embodiment uses the flowchart of FIG. 8A in the case of the large-scale configuration. In addition, the flowchart of FIG. 8B is used in the case of the small-scale configuration. In the flowchart of FIG. 8A suited to the large-scale configuration, the CPU proceeds to step 801 to make a decision as to whether or not a tone-color selection event is detected. When a result of the decision shows that the tone-color selection event is detected, the CPU proceeds to step 802 in which a tone-color-parameter set corresponding to a tone color selected by the tone-color selection event is sent to the parameter RAM of the DSP provided inside of the musical tone generation section having the large-scale configuration. In the case of the large-scale configuration, all the parameters shown in FIG. 4A are incorporated into the tone-color-parameter set. In next step 803, the CPU performs a tone-color-parameter editing process. Thereafter, the CPU ends an execution of the tone-color selection process of FIG. 8A. Incidentally, the tone-color-parameter editing process is adequately performed when a user intends to edit the tone-color parameters.

In the tone-color selection process of FIG. 8B suited to the small-scale configuration, the CPU firstly proceeds to step 811 in which a decision is made as to whether or not a tone-color selection event is detected. If the tone-color selection event is detected, the CPU proceeds to step 812 in which a decision is made as to whether or not '0' is set to a mode flag MODEFLG. Herein, a value of the mode flag MODEFLG represents a mode currently selected. So, the first mode is selected when MODEFLG=0, whilst the second mode is selected when MODEFLG=1. In the first mode (i.e., MODEFLG=0), the CPU proceeds to step 813 in which a microprogram MPMODE0 corresponding to the first mode (MODE0) of a tone color currently selected is transferred to the microprogram RAM of the DSP. This microprogram is suited to the aforementioned algorithm (see FIG. 5) which includes the subsidiary physical model section 503 and excludes the resonance characteristic imparting section 505. In step 814, a set of tone-color parameters (see FIG. 4B) corresponding to the first mode are selected from among a tone-color-parameter set 'PARSETx' provided for the selected tone color and are transferred to the parameter RAM of the DSP. After completion of the step 814, the CPU proceeds to step 817.

On the other hand, when the CPU detects in step 812 that the second mode (i.e., MODEFLG=1) is selected, the CPU proceeds to step 815 in which a microprogram 'MPMODE1' corresponding to the second mode (MODE1) of the selected tone color is transferred to the microprogram RAM of the DSP. This microprogram corresponds to the aforementioned algorithm (see FIG. 5) which excludes the subsidiary physical model section 503 but includes the resonance characteristic imparting section 505. In step 816, a set of tone-color parameters (see FIG. 4C) corresponding to the second mode are selected from among the tone-color-parameter set PARSETx of the selected tone color and are transferred to the parameter RAM of the DSP. After completion of the step 816, the CPU proceeds to step 817.

In step 817, the CPU performs a tone-color-parameter editing process. This process is executed adequately when a user intends to edit the tone-color parameters. In addition, the tone-color-parameter editing process includes a mode switching process to switch over the value of the mode flag MODEFLG between '0' and '1' in response to a manipulation of the mode select switch as well as a saving process to save edited tone-color parameters. After completion of the step 817, a program control returns to the main program.

Figure 7A:
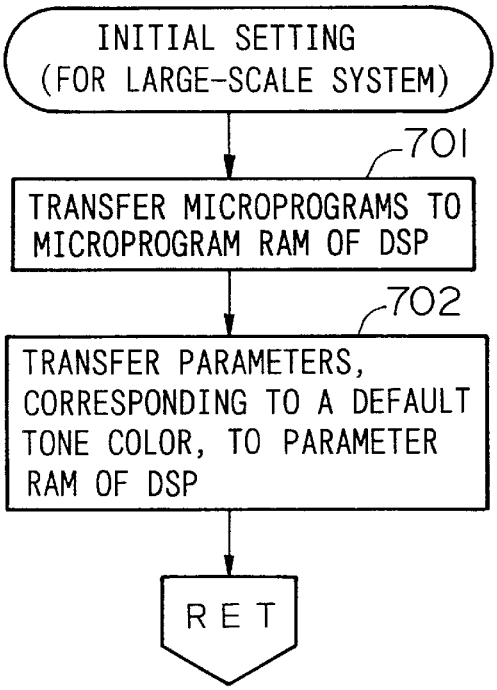
FIG. 7A is a flowchart showing an initial setting process for a large-scale configuration.
Figure 7B:
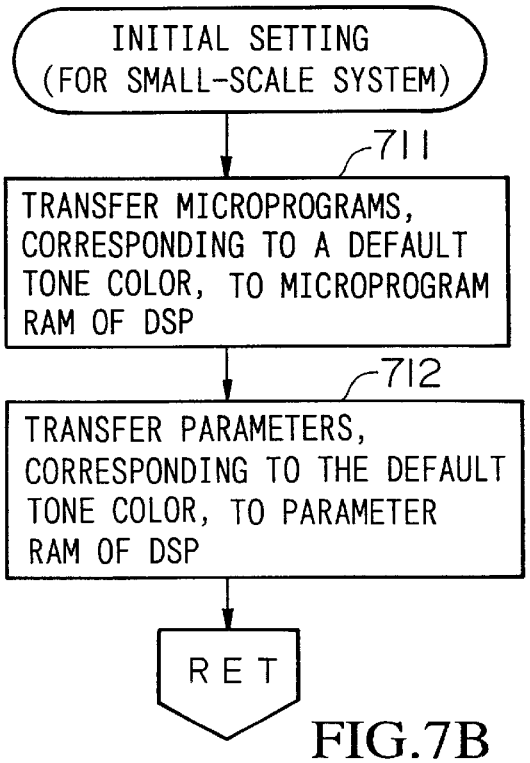
FIG. 7B is a flowchart showing an initial setting process for a small-scale configuration.

FIGS. 7A and 7B are flowcharts showing procedures provided for the initial setting process of step 601 in FIG. 6. Herein, the flowchart of FIG. 7A is selected in the case of the large-scale configuration, whilst the flowchart of FIG. 7B is selected in the case of the small-scale configuration. In the initial setting process of FIG. 7A suited to the large-scale configuration, the CPU firstly proceeds to step 701 in which a microprogram corresponding to a 'default' tone color is transferred to the microprogram RAM of the DSP. In step 702, a tone-color-parameter set corresponding to the default tone color is transferred to the parameter RAM of the DSP. After completion of the step 702, a program control returns the main program.

In the initial setting process of FIG. 7B suited to the small-scale configuration, the CPU firstly proceeds to step 711 in which a microprogram corresponding to a 'default' tone color and a 'default' mode is transferred to the microprogram RAM of the DSP. Herein, the first mode is designated as the default mode. In step 712, tone-color parameters corresponding to the default mode are selected from among a tone-color-parameter set corresponding to the default tone color and are transferred to the parameter RAM of the DSP. Then, a program control returns to the main program.

Incidentally, the present embodiment described heretofore can be modified to provide tone-color variations with respect to the tone colors in connection of the mode by increasing a number of parameters other than the common parameters. As for the parameter SUBPAR which is selected for the first mode (see FIG. 4B) other than the common parameters, for example, it is possible to provide tone-color variations such as SUBPAR1, SUBPAR2, . . . So, multiple parameters are listed as the parameter SUBPAR and are stored in the ROM 102 in advance. Thus, at least one parameter 'SUBPARn' is selected by the user and is transferred to the DSP. Such a manner of storage of the tone-color parameters enables the apparatus to provide tone-color variations with respect to a 'base' tone color, e.g., a tone color of saxophone. That is, it is possible to provide tone-color variations, such as saxophone 1, saxophone 2, . . . , with respect to the tone color of saxophone. Herein, the common parameters are shared between the tone-color variations and base tone color, which are fundamentally equivalent to each other. However, each of the tone-color variations is delicately different from the base tone color.

Lastly, this invention can be applied to a variety of sound source systems other than the physical-model sound sources. For example, this invention is applicable to the waveform-memory-read-out-type sound sources and frequency-modulation-type sound sources. U.S. Pat. No. 4,843,938, the disclosure of which is herein incorporated by reference, discloses a musical tone producing device of waveshape memory readout, which teaches an example of the waveform-memory-read-out-type sound source to which this invention is applicable. U.S. Pat. No. 4,297,933, the disclosure of which is herein incorporated by reference, discloses an electronic musical instrument for tone formation by selectable tone synthesis computations, which teaches an example of the frequency-modulation-type sound source, utilizing the FM algorithms arbitrarily selected, to which this invention is applicable. Further, this invention is applicable to the so-called 'software' sound sources which are realized by executing certain types of musical-tone-synthesis algorithms. Japanese Patent Laid-Open No. 9-6364 (which corresponds to the U.S. patent application Ser. No. 08/666,671, filed with the U.S. Patent Office on Jun. 18, 1996), the disclosure of which is herein incorporated by reference, discloses an example of the software sound source to which this invention is applicable. If this invention is applied to the software sound source, the CPU is designed to execute the musical-tone-synthesis program as well as the automatic performance program and operating system, thus realizing generation of musical tones. So, the function of the aforementioned musical tone generation section 107 is incorporated to the CPU 101 in FIG. 1. Incidentally, the difference in scale of the system of the musical tone generation section 107 is provided by the difference of the version of the sound-source software.

The above sound sources can be realized by modifying the present embodiment of the invention. Herein, parameters used in the algorithm realizing each sound source are determined in response to the necessity to provide a tone color control circuit (e.g., filter) and the necessity to provide an effect control circuit as well as a kind of an effect which can be imparted to musical tones produced by each sound source.

Figure 9:
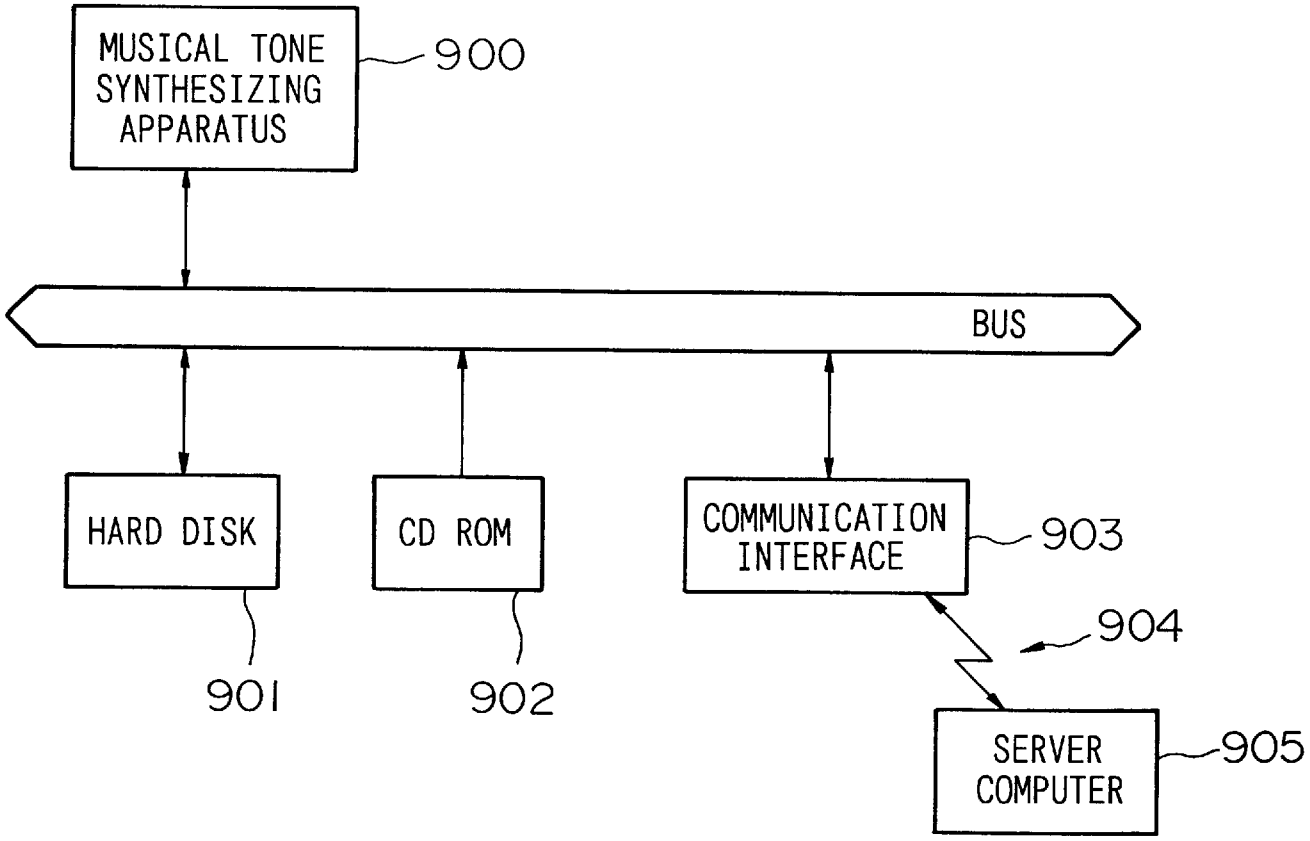
FIG. 9 is a block diagram showing a system to which the invention is applicable.

Moreover, applicability of the invention can be extended in a variety of manners. For example, FIG. 9 shows a system containing a musical tone synthesizing apparatus 900 which corresponds to the musical tone synthesizing apparatus of this invention. Now, the musical tone synthesizing apparatus 900 is connected to a hard-disk unit 901, a CD-ROM unit 902 and a communication interface 903 through a bus. Herein, a variety of data and a variety of programs (e.g., musical-tone-synthesis programs) are stored in the hard-disk unit 901 and/or a CD-ROM of the CD-ROM unit 902. Other than the CD-ROM, it is possible to employ any kinds of external storage media such as floppy disks and magneto-optic disks.

The communication interface 903 is connected to a communication network 904 such as a local area network (LAN), a computer network such as 'internet' or telephone lines. The communication network 904 is connected to a server computer 905. So, programs and data can be downloaded to the musical tone synthesizing apparatus 900 from the server computer 905. Herein, the system issues commands to request 'download' of the programs and data from the server computer 905; thereafter, the programs and data are transferred to the system and are stored in the hard-disk unit 901 and the like.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical tone synthesizing apparatus comprising:

storing means for storing a prescribed set of tone-color parameters which are suited to a prescribed musical tone generation method;

tone-color-parameter providing means for providing at least a part of the tone-color parameters in response to a musical-tone-synthesis algorithm; and processor means for executing the musical-tone-synthesis algorithm by using the at least a part of the tone-color parameters so as to synthesize musical-tone waveforms with regard to a desired tone color.

2. A musical tone synthesizing apparatus according to claim 1 wherein the musical-tone-synthesis algorithm simulates a tone-generation mechanism of a musical instrument of the desired tone color.

3. A musical tone synthesizing apparatus according to claim 1 wherein the musical-tone-synthesis algorithm corresponds to a waveform-memory-read-out-type sound source.

4. A musical tone synthesizing apparatus according to claim 1 wherein the musical-tone-synthesis algorithm corresponds to a frequency-modulation-type sound source.

5. A musical tone synthesizing apparatus comprising:

storing means for storing a prescribed set of tone-color parameters which are suited to a prescribed musical tone generation method;

tone-color-parameter providing means for providing the tone-color parameters in response to a musical-tone-synthesis algorithm, wherein at least a part of the tone-color parameters is determined to be commonly shared by different systems; and processor means for executing the musical-tone-synthesis algorithm by using the tone-color parameters so as to synthesize musical-tone waveforms with regard to a desired tone color.

6. A musical tone synthesizing apparatus according to claim 5 wherein the musical-tone-synthesis algorithm simulates a tone-generation mechanism of a musical instrument of the desired tone color.

7. A musical tone synthesizing apparatus according to claim 5 wherein the musical-tone-synthesis algorithm corresponds to a waveform-memory-read-out-type sound source.

8. A musical tone synthesizing apparatus according to claim 5 wherein the musical-tone-synthesis algorithm corresponds to a frequency-modulation-type sound source.

9. A musical tone synthesizing apparatus comprising:

selecting means for selecting one of musical-tone-synthesis algorithms;

storing means for storing a set of tone-color parameters which contain common parameters, which are commonly shared by the musical-tone-synthesis algorithms, and selective parameters, at least one of which is selectively used in response to the musical-tone-synthesis algorithm selected by the selecting means;

reading means for accessing to the storing means to read out the common parameters and at least one of the selective parameters which is used by the selected musical-tone-synthesis algorithm; and processor means for executing the selected musical-tone-synthesis algorithm, using the common parameters and the at least one of the selective parameters, to synthesize musical-tone waveforms with regard to a desired tone color.

10. A musical tone synthesizing apparatus according to claim 9 wherein each of the musical-tone-synthesis algorithms simulates a tone-generation mechanism of a musical instrument of a specific tone color.

11. A musical tone synthesizing apparatus according to claim 9 wherein the musical-tone-synthesis algorithm corresponds to a waveform-memory-read-out-type sound source.

12. A musical tone synthesizing apparatus according to claim 9 wherein the musical-tone-synthesis algorithm corresponds to a frequency-modulation-type sound source.

13. A musical tone synthesizing apparatus comprising:

mode selecting means for selecting either a first mode or a second mode;

tone-color-parameter storing means for storing tone-color parameters, wherein the tone-color parameters contain common parameters, which are commonly shared by the first mode and the second mode, as well as selective parameters which contain a first-mode parameter exclusively used for the first mode and a second-mode parameter exclusively used for the second mode;

program storing means for storing programs which contain a first-mode program provided for the first mode and a second-mode program provided for the second mode; and processor means for executing the programs using the tone-color parameters to synthesize musical-tone waveforms with regard to a desired tone color, wherein when the first mode is selected, the processor means executes the first-mode program using the common parameters and the first-mode parameter, whilst when the second mode is selected, the processor means executes the second-mode program using the common parameters and the second-mode parameter.

14. A musical tone synthesizing apparatus according to claim 13 wherein each of the programs simulates a tone-generation mechanism of a musical instrument of a specific tone color.

15. A musical tone synthesizing apparatus according to claim 13 wherein the program corresponds to an algorithm of a waveform-memory-read-out-type sound source.

16. A musical tone synthesizing apparatus according to claim 13 wherein the program corresponds to an algorithm of a frequency-modulation-type sound source.

17. A musical tone synthesizing apparatus comprising:

algorithm storing means for storing musical-tone-synthesis algorithms;

parameter storing means for storing tone-color parameters which contain common parameters and selective parameters, wherein the common parameters are commonly shared by different systems, whilst the selective parameters are provided for a selective use of the musical-tone-synthesis algorithms;

selecting means for selecting one of the musical-tone-synthesis algorithms; and processor means for executing the selected musical-tone-synthesis algorithm, selected by the selecting means, by using the common parameters and at least one of the selective parameters, thus synthesizing musical-tone waveforms with regard to a desired tone color.

18. A musical tone synthesizing apparatus according to claim 17 wherein each of the musical-tone-synthesis algorithms simulates a tone-generation mechanism of a musical instrument of a specific tone color.

19. A musical tone synthesizing apparatus according to claim 17 wherein the processor means corresponds to a digital signal processor.

20. A musical tone synthesizing apparatus according to claim 17 wherein the musical-tone-synthesis algorithms contain partially modified algorithms with respect to derivative tone colors which derive from a base tone color corresponding to a real musical instrument.

21. A musical tone synthesizing apparatus according to claim 17 wherein each of the musical-tone-synthesis algorithms contains a basic portion corresponding to basic functions commonly shared by the tone-generation mechanisms to be simulated and a peripheral portion corresponding to a function additionally provided for each of the tone-generation mechanisms to be simulated.

22. A musical tone synthesizing apparatus comprising:

a storage device which stores a prescribed set of tone-color parameters which are suited to a prescribed musical tone generation method;

a tone-color-parameter provider which provides at least a part of the tone-color parameters in response to a musical-tone-synthesis algorithm; and a processor, connected to the tone-color-parameter provider, which executes the musical-tone-synthesis algorithm by using the at least part of the tone-color parameters and thereby synthesizes musical-tone waveforms with regard to a desired tone color.

23. A musical tone synthesizing apparatus comprising:

a storage device which stores a prescribed set of tone-color parameters which are suited to a prescribed musical tone generation method;

a tone-color-parameter provider which provides the tone-color parameters in response to a musical-tone-synthesis algorithm, wherein at least a part of the tone-color parameters is determined to be commonly shared by different systems; and a processor, connected to the tone-color-parameter provider, which executes the musical-tone-synthesis algorithm by using the tone-color parameters and thereby synthesizes musical-tone waveforms with regard to a desired tone color.

24. A musical tone synthesizing apparatus comprising:

a selector which selects one of musical-tone-synthesis algorithms, each simulating a tone-generation mechanism of a musical instrument having a specific tone color;

a storing device which stores a set of tone-color parameters which contain common parameters, which are commonly shared by the musical-tone-synthesis algorithms, and selective parameters, at least one of which is selectively used in response to the musical-tone-synthesis algorithm selected by the selector; and a processor, connected to the selector and the storing device, which accesses to the storing device to read out the common parameters and at least one of the selective parameters which is used by the selected musical-tone-synthesis algorithm, wherein the processor executes the selected musical-tone-synthesis algorithm, using the common parameters and the at least one of the selective parameters, to synthesize musical-tone waveforms with regard to a desired tone color.

25. A musical tone synthesizing apparatus comprising:

a mode selector which selects either a first mode or a second mode;

a tone-color-parameter storing device which stores tone-color parameters, wherein the tone-color parameters contain common parameters, which are commonly shared by the first mode and the second mode, as well as selective parameters which contain a first-mode parameter exclusively used for the first mode and a second-mode parameter exclusively used for the second mode;

a program storing device which stores programs containing a first-mode program provided for the first mode and a second-mode program provided for the second mode; and a processor, connected to the mode selector, the tone-color-parameter storing device and the program storing device, which executes the programs using the tone-color parameters to synthesize musical-tone waveforms with regard to a desired tone color, wherein when the first mode is selected, the processor executes the first-mode program using the common parameters and the first-mode parameter, whilst when the second mode is selected, the processor executes the second-mode program using the common parameters and the second-mode parameter.

26. A computer-readable media storing programs which cause a system using a processor to execute a musical-tone-synthesis method comprising the steps of:

storing a prescribed set of tone-color parameters which are suited to a prescribed musical tone generation method;

providing at least a part of the tone-color parameters in response to a musical-tone-synthesis algorithm; and executing the musical-tone-synthesis algorithm by using the at least a part of the tone-color parameters so as to synthesize musical-tone waveforms with regard to a desired tone color.

27. A computer-readable media storing programs which cause a system using a processor to execute a musical-tone-synthesis method comprising the steps of:

storing a prescribed set of tone-color parameters which are suited to a prescribed musical tone generation method;

providing the tone-color parameters in response to a musical-tone-synthesis algorithm, wherein at least a part of the tone-color parameters is determined to be commonly shared by different systems; and executing the musical-tone-synthesis algorithm by using the tone-color parameters so as to synthesize musical-tone waveforms with regard to a desired tone color.

28. A computer-readable media storing programs which cause a system using a processor to execute a musical-tone-synthesis method comprising the steps of:

selecting one of musical-tone-synthesis algorithms;

storing a set of tone-color parameters which contain common parameters, which are commonly shared by the musical-tone-synthesis algorithms, and selective parameters, at least one of which is selectively used in response to the selected musical-tone-synthesis algorithm;

reading out common parameters and at least one of the selective parameters which is used by the selected musical-tone-synthesis algorithm; and executing the selected musical-tone-synthesis algorithm, using the common parameters and the at least one of the selective parameters, to synthesize musical-tone waveforms with regard to a desired tone color.

29. A computer-readable media storing programs which cause a system using a processor to execute a musical-tone-synthesis method comprising the steps of:

selecting either a first mode or a second mode;

storing tone-color parameters, wherein the tone-color parameters contain common parameters, which are commonly shared by the first mode and the second mode, as well as selective parameters which contain a first-mode parameter exclusively used for the first mode and a second-mode parameter exclusively used for the second mode;

storing programs which contain a first-mode program provided for the first mode and a second-mode program provided for the second mode; and executing the programs using the tone-color parameters to synthesize musical-tone waveforms with regard to a desired tone color, wherein when the first mode is selected, the first mode program is executed using the common parameters and the first-mode parameter, whilst when the second mode is selected, the second-mode program is executed using the common parameters and the second-mode parameter.

* * * * *